US010061253B2

(12) United States Patent
Harada

(10) Patent No.: US 10,061,253 B2
(45) Date of Patent: Aug. 28, 2018

(54) IMAGE FORMING APPARATUS

(71) Applicant: KYOCERA Document Solutions Inc., Osaka (JP)

(72) Inventor: Hiroyuki Harada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/162,873

(22) Filed: May 24, 2016

(65) Prior Publication Data

US 2016/0349689 A1 Dec. 1, 2016

(30) Foreign Application Priority Data

May 26, 2015 (JP) ..... 2015-106445

(51) Int. Cl.
*B65H 31/24* (2006.01)
*G03G 15/00* (2006.01)
*B65H 31/02* (2006.01)

(52) U.S. Cl.
CPC ..... *G03G 15/6529* (2013.01); *B65H 31/02* (2013.01); *B65H 31/24* (2013.01);
(Continued)

(58) Field of Classification Search
CPC .. B65H 2301/421; B65H 29/60; B65H 29/62; B65H 29/64; B65H 29/6672;
(Continued)

(56) References Cited

U.S. PATENT DOCUMENTS 5,999,765 A * 12/1999 Tomita ..... G03G 15/6588 399/45
6,134,418 A * 10/2000 Kato ..... B65H 29/00 271/207

(Continued)

FOREIGN PATENT DOCUMENTS

JP 63-171769 * 7/1988
JP H10-048901 A 2/1998

(Continued)

OTHER PUBLICATIONS

JP Office Action dated Dec. 26, 2017, from corresponding JP Appl No. 2015-106445, with English translation, 5 pp.

*Primary Examiner* — Thomas A Morrison
(74) *Attorney, Agent, or Firm* — Studebaker & Brackett PC

(57) ABSTRACT

An image forming apparatus includes an image forming section, a primary conveyance section, a first diverging section, a sorting ejection section, a secondary conveyance section, and a housing. The first diverging section is located downstream of the image forming section in a paper conveyance direction in the primary conveyance section. The secondary conveyance section diverges from the primary conveyance section at the first diverging section. The sorting ejection section sorts and ejects the paper conveyed thereto by the secondary conveyance section. The housing constitutes an apparatus main body and houses the image forming section, the primary conveyance section, the first diverging section, and part of the secondary conveyance section. One side wall of a plurality of side walls of the housing has an opening. The secondary conveyance section conveys the paper to a proximal end of the sorting ejection section through the opening.

6 Claims, 4 Drawing Sheets

(52) U.S. Cl.
CPC ..... *G03G 15/6552* (2013.01); *B65H 2405/11151* (2013.01); *B65H 2405/332* (2013.01); *B65H 2408/111* (2013.01); *B65H 2801/06* (2013.01); *G03G 2215/00421* (2013.01)

(58) Field of Classification Search
CPC ..... B65H 2301/4217; B65H 2408/11; B65H 31/24; B65H 2408/112; B65H 31/02; G03G 15/6529
USPC ..... 271/279, 287, 297
See application file for complete search history.

(56) References Cited

U.S. PATENT DOCUMENTS

| | | | | |
|---|---|---|---|---|
| 6,240,273 | B1 * | 5/2001 | Kakigi | G03G 15/6538 271/279 |
| 6,308,952 | B1 * | 10/2001 | Takagi | B65H 31/22 271/297 |
| 6,522,862 | B2 * | 2/2003 | Koshimizu | G03G 15/6538 399/362 |
| 8,276,912 | B2 * | 10/2012 | Yang | B65H 29/58 271/298 |
| 8,335,465 | B2 * | 12/2012 | Tsuchida | G03G 15/6529 271/185 |
| 2001/0031162 | A1 | 10/2001 | Koshimizu et al. | |

FOREIGN PATENT DOCUMENTS

| | | | |
|---|---|---|---|
| JP | 10-087156 | A | 4/1998 |
| JP | 2001-302064 | A | 10/2001 |
| JP | 2012-027256 | A | 2/2012 |

* cited by examiner

IMAGE FORMING APPARATUS

INCORPORATION BY REFERENCE

The present application claims priority under 35 U.S.C. § 119 to Japanese Patent Application No. 2015-106445, filed on May 26, 2015. The contents of this application are incorporated herein by reference in their entirety.

BACKGROUND

The present disclosure relates to image forming apparatuses.

Known image forming apparatuses form images on paper, and sort and eject the paper having the images formed thereon. One of such image forming apparatuses includes a plurality of trays arranged one above another. In the image forming apparatus, a paper exit port and the plurality of trays are disposed over an image forming section. Thus, the image forming apparatus is prevented from increasing in size.

SUMMARY

An image forming apparatus according to an aspect of the present disclosure includes an image forming section, a primary conveyance section, a first diverging section, a sorting ejection section, a secondary conveyance section, and a housing. The image forming section forms an image on paper. The primary conveyance section conveys the paper from the image forming section and ejects the paper. The first diverging section is located downstream of the image forming section in a paper conveyance direction in the primary conveyance section. The secondary conveyance section diverges from the primary conveyance section at the first diverging section. The sorting ejection section sorts and ejects the paper conveyed thereto by the secondary conveyance section. The housing constitutes an apparatus main body and houses the image forming section, the primary conveyance section, the first diverging section, and part of the secondary conveyance section. One side wall of a plurality of side walls of the housing has an opening. The secondary conveyance section conveys the paper to a proximal end of the sorting ejection section through the opening. The proximal end of the sorting ejection section is located adjacent to an end portion of the secondary conveyance section at a side farther from the first diverging section.

DETAILED DESCRIPTION

Figure 1:
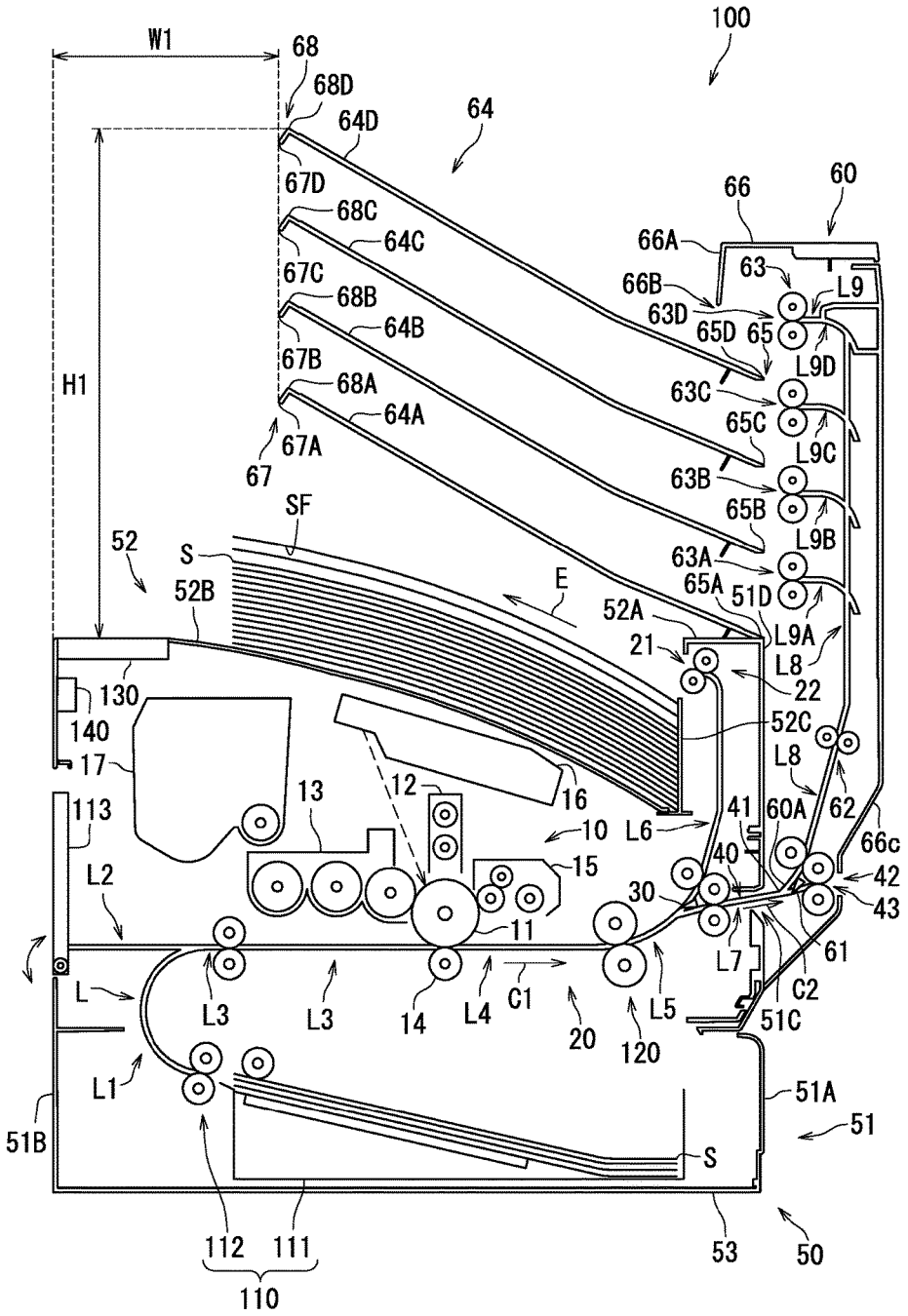
FIG. 1 is a side view illustrating an image forming apparatus according to an embodiment of the present disclosure.

The following describes an embodiment of the present disclosure with reference to the accompanying drawings. Elements that are the same or equivalent are indicated by the same reference signs in the drawings and description thereof is not repeated. A top-bottom direction in the present embodiment refers to a vertical direction.

The following describes configuration of an image forming apparatus 100 according to the embodiment of the present disclosure with reference to FIG. 1. FIG. 1 is a side view illustrating the image forming apparatus 100. The image forming apparatus 100 in the present embodiment is a printer.

The image forming apparatus 100 includes an image forming unit 10, a primary conveyance section 20, a first diverging section 30, a secondary conveyance section 40, a housing 50, a sorting ejection section 60, a feeder 110, a fixing section 120, an operation display section 130, and a controller 140. The controller 140 controls operation of the image forming unit 10, the primary conveyance section 20, the first diverging section 30, the secondary conveyance section 40, the sorting ejection section 60, the feeder 110, the fixing section 120, and the operation display section 130.

The image forming apparatus 100 has conveyance paths L. The conveyance paths L include conveyance paths L1 to L9. The conveyance paths L are formed from guide members such as guide plates and guide rollers.

The housing 50 constitutes an apparatus main body and includes four side walls 51, a top wall 52, and a bottom wall 53. The housing 50 is for example made from a synthetic resin and has a substantially rectangular parallelepiped shape. The side walls 51 are plate members stood from edges of the bottom wall 53. One of the four side walls 51 has an opening 51C. Hereinafter, the side wall 51 having the opening 51C is referred to as "a first side wall 51A" and the side wall 51 opposite to the first side wall 51A is referred to as "a second side wall 51B". Preferably, the opening 51C of the first side wall 51A is located at a level between a level of an upper end of the image forming unit 10 and a level of a lower end of the image forming unit 10. The top wall 52 is a wall that forms a top face of the housing 50. The top wall 52 includes an end portion 52A connected with the first side wall 51A and an inclined primary exit tray 52B, and an inner wall 52C. The primary exit tray 52B is substantially rectangular. The end portion 52A is connected with an upper end 51D of the first side wall 51A. The inner wall 52C is stood from one end portion (right-hand end portion in FIG. 1) of the primary exit tray 52B. An upper end of the inner wall 52C is connected with one end (left-hand end in FIG. 1) of the end portion 52A. The housing 50 houses the image forming unit 10, the primary conveyance section 20, the first diverging section 30, part of the secondary conveyance section 40, the feeder 110, the fixing section 120, and the controller 140.

The feeder 110 includes a cassette 111, feeding rollers 112, and a manual feed tray 113. The cassette 111 accommodates a stack of sheets of paper S. The sheets of paper S may for example be plain paper, recycled paper, thin paper, thick paper, or overhead projector (OHP) sheets. The feeding rollers 112 feed the paper S from the cassette 111 to the conveyance path L1. The manual feed tray 113 is openably and closably provided in the second side wall 51B. Paper S (for example, thick paper) is loaded on the manual feed tray 113. The paper S is fed from the manual feed tray 113 to the conveyance path L2. The paper S is conveyed to the image forming unit 10 through the conveyance path L1 and the conveyance path L3 or through the conveyance path L2 and the conveyance path L3.

The image forming unit 10 forms an image on paper S. More specifically, the image forming unit 10 includes a photosensitive drum 11, a charger 12, a development section 13, a transfer section 14, a cleaning section 15, a light exposure section 16, and a toner cartridge 17.

The photosensitive drum 11 rotates in a direction along a conveyance direction C1 of the paper S (a counterclockwise direction in FIG. 1). The charger 12 charges a surface of the photosensitive drum 11. The light exposure section 16 irradiates the surface of the photosensitive drum 11 with laser light based on image data. As a result, an electrostatic latent image based on the image data is formed on the surface of the photosensitive drum 11. The development section 13 causes toner to adhere to the electrostatic latent image to form a toner image on the surface of the photosensitive drum 11. The toner cartridge 17 contains the toner and supplies the toner to the development section 13.

The transfer section 14 transfers the toner image to the paper S by pressing the paper S against the surface of the photosensitive drum 11. The cleaning section 15 removes residual toner remaining on the surface of the photosensitive drum 11.

The paper S having the toner image transferred thereto is conveyed to the fixing section 120 through the conveyance path L4. The fixing section 120 applies heat and pressure to the paper S to fix the toner image to the paper S. The paper S having the toner image fixed thereto by the fixing section 120 is conveyed to the first diverging section 30 through the conveyance path L5. The image forming unit 10 and the fixing section 120 are equivalent to an example of the "image forming section".

The primary conveyance section 20 includes a primary exit port 21, a primary ejection roller pair 22, the conveyance paths L1 to L6, a plurality of conveyance roller pairs, and a drive mechanism (not illustrated). After the paper S is fed from the cassette 111 or the manual feed tray 113, the primary conveyance section 20 conveys the paper S through the image forming unit 10 and the fixing section 120 and ejects the paper S to the primary exit tray 52B such that a printed side SF of the paper S is facing downward. The printed side SF refers to a side, among the two sides of the paper S, on which an image has been formed by the image forming unit 10 and the fixing section 120. Hereinafter, a state in which the printed side SF is facing downward is described as "face-down". Likewise, a state in which the printed side SF is facing upward is described as "face-up".

The primary exit port 21 is located in the vicinity of the upper end of the inner wall 52C. The primary ejection roller pair 22 is disposed in the vicinity of the primary exit port 21. The primary ejection roller pair 22 conveys the paper S in an ejection direction E to eject the paper S face-down through the primary exit port 21. The paper S ejected is placed on a top surface of the primary exit tray 52B. The primary exit tray 52B is inclined diagonally upward in the ejection direction E of the paper S. An upstream end portion of the paper S placed on the primary exit tray 52B in terms of the ejection direction E abuts against the inner wall 52C.

The plurality of conveyance roller pairs are disposed along the conveyance paths L. The drive mechanism for example includes a gear train and a drive source such as a motor. The paper S is conveyed through the plurality of conveyance roller pairs being driven by the drive mechanism.

The first diverging section 30 is located downstream of the image forming unit 10 in the paper conveyance direction C1. The first diverging section 30 allows the secondary conveyance section 40 to diverge from the primary conveyance section 20 at one end portion (left-hand end portion in FIG. 1) of the secondary conveyance section 40. The first diverging section 30 includes a diverging guide and a motor. The controller 140 controls driving of the motor according to a preset ejection destination of the paper S. The diverging guide operates through the controlled driving of the motor to block the primary conveyance section 20 or the secondary conveyance section 40. When the diverging guide operates to block the secondary conveyance section 40, the paper S is conveyed from the conveyance path L5 to the conveyance path L6. The paper conveyed through the conveyance path L6 is ejected to the primary exit tray 52B by the primary ejection roller pair 22. When the diverging guide operates to block the primary conveyance section 20, the paper S is conveyed from the conveyance path L5 to the conveyance path L7.

The secondary conveyance section 40 includes the conveyance path L7, a plurality of conveyance roller pairs (not illustrated), and a drive mechanism (not illustrated). The plurality of conveyance roller pairs and the drive mechanism in the secondary conveyance section 40 have the same configuration as the plurality of conveyance roller pairs and the drive mechanism included in the primary conveyance section 20. The secondary conveyance section 40 diverges from the primary conveyance section 20 at the first diverging section 30. That is, when the diverging guide of the first diverging section 30 operates to block the primary conveyance section 20, the paper S is conveyed from the conveyance path L5 to the conveyance path L7. The secondary conveyance section 40 conveys the paper S in a paper conveyance direction C2 through the opening 51C. The secondary conveyance section 40 conveys the paper S to a proximal end 60A of the sorting ejection section 60.

The secondary conveyance section 40 further includes a secondary exit port 42 (exit port) and a secondary ejection roller pair 43. The secondary exit port 42 is located downstream of a second diverging section 61 in the paper conveyance direction C2 in the secondary conveyance section 40. Preferably, the primary conveyance section 20 and the secondary conveyance section 40 convey the paper S (for example, thick paper) having passed through the image forming unit 10 and the fixing section 120 in a substantially horizontal direction toward the secondary exit port 42. The secondary conveyance section 40 ejects the paper S face-up through the secondary exit port 42.

The sorting ejection section 60 sorts and ejects the paper S conveyed thereto by the secondary conveyance section 40. The sorting ejection section 60 includes the second diverging section 61, a sorting conveyance section 62, sorting ejection roller pairs 63, exit trays 64, a cover portion 66, the conveyance path L8, the conveyance paths L9, a plurality of conveyance roller pairs (not illustrated), and a drive mechanism (not illustrated). The plurality of conveyance roller pairs and the drive mechanism in the sorting ejection section 60 have the same configuration as the plurality of conveyance roller pairs and the drive mechanism included in the primary conveyance section 20.

The second diverging section 61 is located downstream of the first diverging section 30 in the paper conveyance direction C2. The second diverging section 61 allows the sorting ejection section 60 to diverge from the secondary conveyance section 40 at a point of connection between the proximal end 60A of the sorting ejection section 60 and the secondary conveyance section 40. The proximal end 60A of the sorting ejection section 60 is located adjacent to an end portion 41 of the secondary conveyance section 40 at a side (right-hand side in FIG. 1) farther from the first diverging section 30. The second diverging section 61 includes a diverging guide and a motor (not illustrated). As in the case of the first diverging section 30, the controller 140 controls driving of the motor of the second diverging section 61 to cause the diverging guide to operate depending on the preset paper ejection destination. When the diverging guide operates to block the secondary conveyance section 40, the paper S is conveyed from the conveyance path L7 to the conveyance path L8. When the diverging guide operates to block the sorting ejection section 60, the paper S is ejected through the secondary exit port 42.

The sorting conveyance section 62 diverges from the secondary conveyance section 40 at the second diverging section 61 and conveys the paper S toward the sorting ejection roller pairs 63. More specifically, the controller 140 controls operation of the plurality of conveyance roller pairs and the drive mechanism, and the sorting conveyance section 62 accordingly conveys the paper S to one of the plurality of sorting ejection roller pairs 63 through the conveyance path L8 and one of the conveyance paths L9. The conveyance path L8 is located at an opposite side of a plane including the first side wall 51A to a side at which the image forming unit 10 is located. The conveyance path L8 extends upward toward the sorting ejection roller pairs 63 and connects to the conveyance paths L9 such that the sorting conveyance section 62 can convey the paper S therethrough.

The sorting ejection roller pairs 63 each eject the paper S to a corresponding one of the exit trays 64. The sorting ejection section 60 for example includes four sorting ejection roller pairs 63. The four sorting ejection roller pairs 63 include a sorting ejection roller pair 63A, a sorting ejection roller pair 63B, a sorting ejection roller pair 63C, and a sorting ejection roller pair 63D. The sorting ejection roller pairs 63A to 63D are arranged in the top-bottom direction at equal intervals. For example, the sorting ejection roller pair 63A is disposed undermost and the sorting ejection roller pair 63D is disposed uppermost. The sorting ejection roller pairs 63 are located at the opposite side of the plane including the first side wall 51A to the side at which the image forming unit 10 is located.

The conveyance paths L9 include a conveyance path L9A, a conveyance path L9B, a conveyance path L9C, and a conveyance path L9D. Each of the conveyance paths L9A to L9D allows the paper S to be conveyed to the corresponding one of the sorting ejection roller pairs 63A to 63D.

The exit trays 64 include an exit tray 64A, an exit tray 64B, an exit tray 64C, and an exit tray 64D. The paper S ejected by each of the ejection roller pairs 63A to 63D is placed on a corresponding one of the exit trays 64A to 64D. The exit trays 64A to 64D are arranged in the top-bottom direction at equal intervals as in the case of the sorting ejection roller pairs 63A to 63D. For example, the exit tray 64A is disposed undermost and the exit tray 64D is disposed uppermost. A proximal end 65A of the exit tray 64A is located in the vicinity of the upper end 51D of the first side wall 51A. In the present embodiment, distal end portions of the exit trays 64A to 64D project downward from upper ends 68A to 68D of the exit trays 64A to 64D, respectively. However, no limitations are placed on the shape of the distal end portions. The upper ends 68A to 68D of the exit trays 64A to 64D may coincide with distal ends 67A to 67D of the exit trays 64A to 64D.

The cover portion 66 is for example a synthetic resin cover having a substantially rectangular parallelepiped shape. The cover portion 66 covers the second diverging section 61, the sorting conveyance section 62, the sorting ejection roller pairs 63, part of the exit trays 64, the conveyance path L8, and the conveyance paths L9. The cover portion 66 is fixed to the first side wall 51A and the top wall 52 of the housing 50. A side face 66A of the cover portion 66 has an opening 66B. The distal ends 67 of the exit trays 64 project through the opening 66B. The secondary exit port 42 includes an opening formed in a side face 66C of the cover portion 66. The side face 66C is located at the opposite side of the plane including the first side wall 51A to the side at which the side face 66A is located.

The operation display section 130 is disposed on one side (left-hand side in FIG. 1) of an upper surface of the top wall 52. The operation display section 130 includes a liquid crystal display (LCD), a switch, and buttons, and receives a user's input operation. The user inputs various settings and instructions into the image forming apparatus 100 through the operation display section 130. The operation display section 130 displays various types of information and the state of the image forming apparatus 100 on the LCD.

In a situation in which an image is formed on four sheets of paper S and the four sheets of paper S having the image formed thereon are to be output, for example, the exit trays 64A to 64D are used to eject the respective four sheets of paper S in a sorted manner. The user can set whether or not to use such a sorting function through an operation on the operation display section 130.

The image forming apparatus 100 is communicatively connected with a plurality of document creator terminals (for example, personal computers) via a network such as a local area network (LAN). The image forming apparatus 100 is capable of forming an image on paper S based on original document data transmitted from each document creator terminal. The image forming apparatus 100 is capable of designating a separate exit tray 64 for each of users of the document creator terminals and ejecting paper S on which an image has been formed to a specified exit tray 64. In other words, the exit trays 64A to 64D are also used as so-called mailboxes.

The user inputs print setting information into the image forming apparatus 100 through the operation display section 130 or a LAN. The print setting information refers to information specifying one of the primary exit port 21, the secondary exit port 42, and the exit trays 64A to 64D as a paper ejection destination. The controller 140 controls the primary conveyance section 20, the first diverging section 30, the secondary conveyance section 40, and the sorting ejection section 60 based on the input print setting information such that the paper S is ejected to the specified paper ejection destination.

Figure 4:
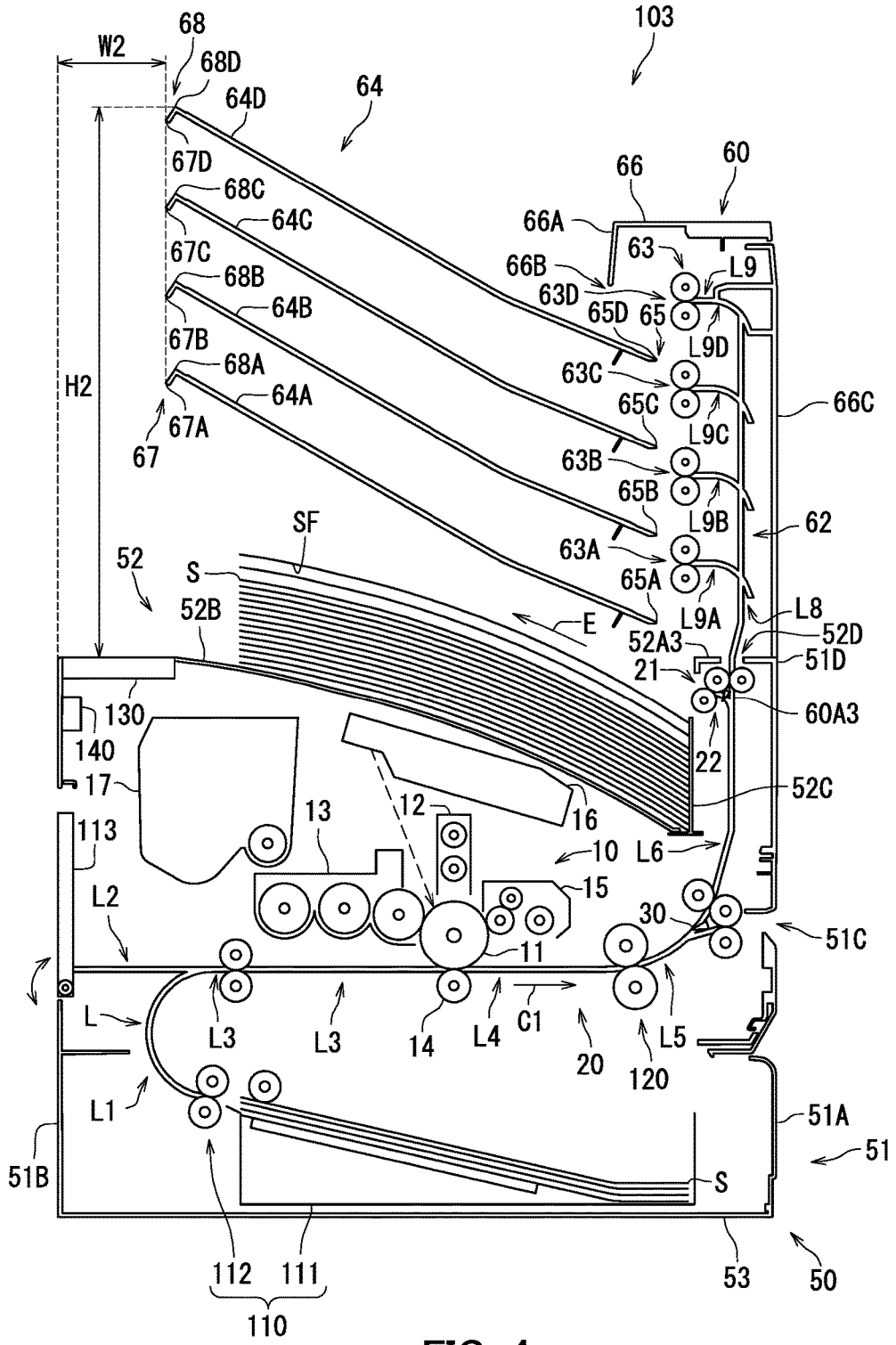
FIG. 4 is a side view illustrating a reference example of the image forming apparatus illustrated in FIG. 1.

The following describes a reference example of the image forming apparatus 100 according to the present embodiment with reference to FIG. 4 in order to facilitate understanding of configuration of the present embodiment. FIG. 4 is a side view illustrating an image forming apparatus 103 according to the reference example. As in the present embodiment, the image forming apparatus 103 according to the reference example is a printer. The image forming apparatus 103 is different from the image forming apparatus 100 of the present embodiment in the following point. The conveyance path L8 of the image forming apparatus 100 according to the present embodiment is located at the opposite side of the plane including the first side wall 51A of the housing 50 to the side at which the image forming unit 10 is located, whereas the conveyance path L8 of the image forming apparatus 103 is located at the same side of the plane including the first side wall 51A as the image forming unit 10. Note that description is omitted with respect to elements of configuration of the image forming apparatus 103 according to the reference example that are the same as or similar to those of the image forming apparatus 100 according to the present embodiment.

The primary conveyance section 20 in the image forming apparatus 103 is capable of conveying paper S to a proximal end 60A3 of the sorting ejection section 60. A point of connection between the proximal end 60A3 of the sorting ejection section 60 and the primary conveyance section 20 is located in the vicinity of the primary ejection roller pair 22. The sorting conveyance section 62 diverges from the primary conveyance section 20 at the point of connection between the proximal end 60A3 of the sorting ejection section 60 and the primary conveyance section 20 and conveys the paper S toward the sorting ejection roller pairs 63. The sorting conveyance section 62 conveys the paper S through an opening 52D formed in an end portion 52A3 of the top wall 52 of the housing 50. The conveyance path L8 is located at the same side of the plane including the first side wall 51A as the image forming unit 10. Because of the location of the conveyance path L8, the sorting ejection roller pairs 63 are located at the same side of the plane including the first side wall 51A as the image forming unit 10.

The proximal ends 65 (proximal ends 65A to 65D) of the exit trays 64 (exit trays 64A to 64D) are located at the same side of the plane including the first side wall 51A as the image forming unit 10. A distance between a plane including the second side wall 51B of the housing 50 and a plane including the distal ends 67 (distal ends 67A to 67D) of the exit trays 64 (exit trays 64A to 64D) is a distance W2.

In contrast to the above-described image forming apparatus 103, the image forming apparatus 100 described with reference to FIG. 1 has the following configuration. That is, the sorting ejection roller pairs 63 are located at the opposite side of the plane including the first side wall 51A to the side at which the image forming unit 10 is located. The proximal ends 65 (proximal ends 65A to 65D) of the exit trays 64 (exit trays 64A to 64D) are located in the vicinity of the plane including the side wall 51A or at the opposite side of the plane including the first side wall 51A to the side at which the image forming unit 10 is located. It is therefore possible to ensure a distance W1 between the plane including the second side wall 51B of the housing 50 and the plane including the distal ends 67 (distal ends 67A to 67D) of the exit trays 64 (exit trays 64A to 64D). That is, it is possible to ensure the distance W1 while maintaining the configuration in which the conveyance path L8 connects to the conveyance paths L9 such that the sorting conveyance section 62 can convey the paper S therethrough. The distance W1 (for example, 130 mm) is greater than the distance W2 (for example, 60 mm), allowing the paper S to be easily taken out.

As described above with reference to FIGS. 1 and 4, in the image forming apparatus 103 according to the reference example, the proximal end 60A3 of the sorting ejection section 60 is located in the vicinity of an upper end of the primary conveyance section 20, and the primary conveyance section 20 conveys the paper S to the proximal end 60A3 of the sorting ejection section 60. Furthermore, the sorting conveyance section 62 conveys the paper S through the opening 52D formed in the end portion 52A3 of the top wall 52 of the housing 50. In contrast, in the image forming apparatus 100 of the present embodiment, the secondary conveyance section 40 can convey the paper S to the proximal end 60A of the sorting ejection section 60 through the opening 51C formed in the first side wall 51A of the housing 50. Thus, the height of the image forming apparatus 100, which has a sorting ejection function, can be reduced.

Furthermore, in the image forming apparatus 100, the secondary conveyance section 40 further includes the secondary exit port 42 and the secondary ejection roller pair 43. The secondary conveyance section 40 ejects the paper S face-up toward the secondary exit port 42. The secondary conveyance section 40 plays both a face-up ejection function and part of the sorting ejection function. The image forming apparatus 100 therefore achieves the face-up ejection function with a simple configuration. Preferably, the primary conveyance section 20 and the secondary conveyance section 40 convey the paper S having passed through the image forming unit 10 and the fixing section 120 in a substantially horizontal direction toward the secondary exit port 42. Thus, in a situation in which the primary conveyance section 20 and the secondary conveyance section 40 convey rigid paper S such as thick paper, load on the paper S can be reduced.

In the image forming apparatus 100, the proximal ends 65 of the exit trays 64 are located on the plane including the first side wall 51A or at the opposite side of the plane including the first side wall 51A to the side at which the image forming unit 10 is located. It is therefore possible to ensure the distance W1 between the plane including the second side wall 51B of the housing 50 and the plane including the distal ends 67 of the exit trays 64. As a result, a user can easily take out the paper S ejected to the primary exit tray 52B.

In the image forming apparatus 103 according to the reference example, a distance between an upper end of the top wall 52 of the housing 50 and the upper end 68D of the uppermost exit tray 64D is a distance H2 (for example, 315 mm). In contrast, in the image forming apparatus 100, the proximal end 60A of the sorting ejection section 60 is located adjacent to the end portion 41 of the secondary conveyance section 40 as mentioned above. Accordingly, the proximal end 65A of the undermost exit tray 64A can be located in the vicinity of the upper end 51D of the first side wall 51A of the housing 50. That is, it is possible to lower levels at which the respective sorting ejection roller pairs 63 are disposed while maintaining the configuration in which the conveyance path L8 connects to the conveyance paths L9 such that the sorting conveyance section 62 can convey the paper S therethrough. Such a configuration can ensure that a distance between the upper end of the top wall 52 of the housing 50 and the upper end 68D of the uppermost exit tray 64D is a distance H1 (for example, 295 mm). The distance H1 is smaller than the distance H2, and thus the height of the image forming apparatus 100 can be configured shorter than the image forming apparatus 103 according to the reference example.

Preferably, in the image forming apparatus 100, the opening 51C of the first side wall 51A is located at a level between the level of the upper end of the image forming unit 10 and the level of the lower end of the image forming unit 10. Thus, it is possible to easily maintain the configuration in which the conveyance path L8 connects to the conveyance paths L9 such that the sorting conveyance section 62 can convey the paper S therethrough.

Figure 2:
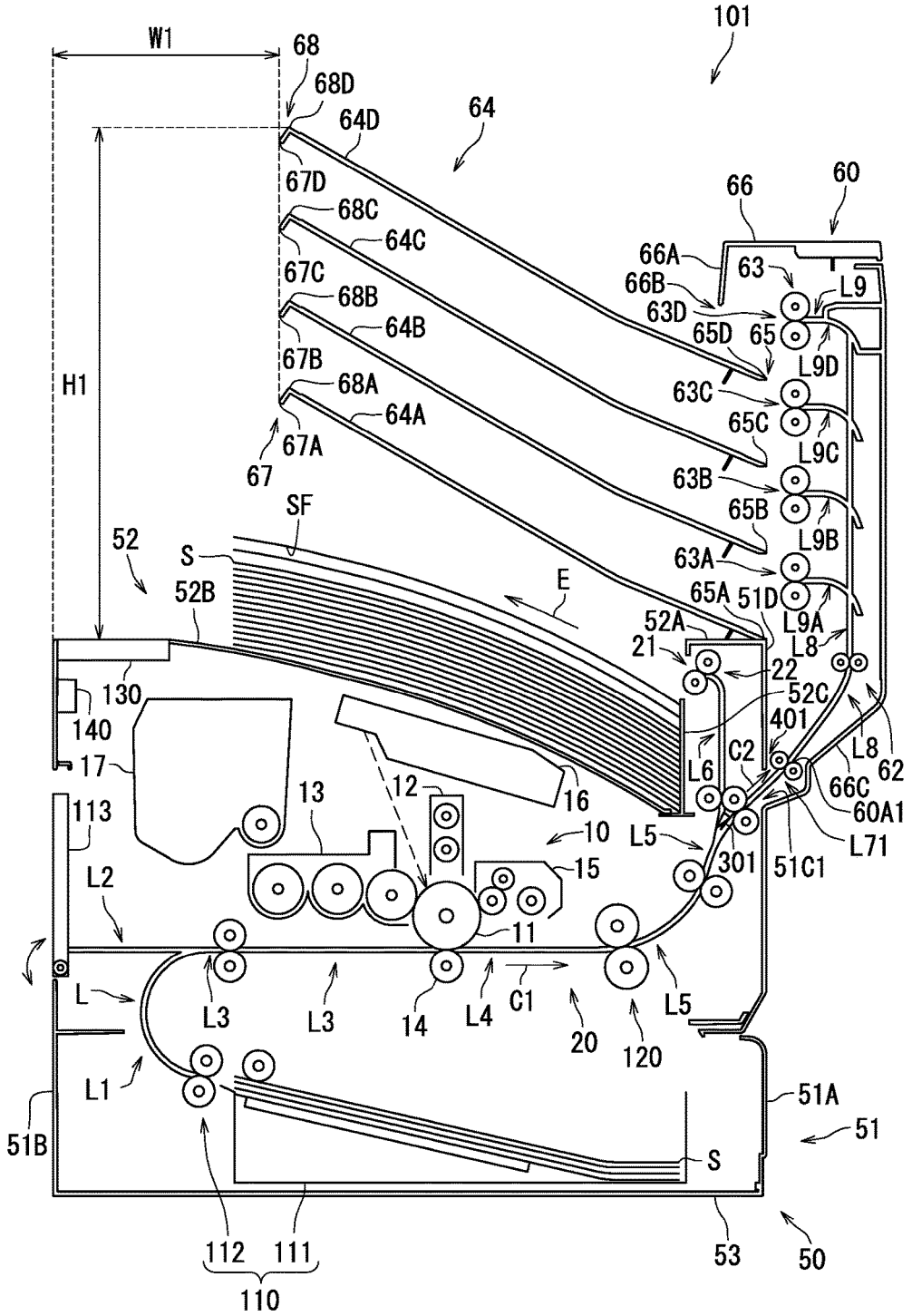
FIG. 2 is a side view illustrating a first variation of the image forming apparatus illustrated in FIG. 1.

The following describes a first variation of the image forming apparatus 100 according to the present embodiment with reference to FIG. 2. FIG. 2 is a side view illustrating an image forming apparatus 101 according to the first variation. The image forming apparatus 101 is different from the image forming apparatus 100 in the following point. That is, in the image forming apparatus 101, the secondary conveyance section 40 does not include the secondary exit port 42 or the secondary ejection roller pair 43, and the sorting ejection section 60 does not include the second diverging section 61.

The image forming apparatus 101 is for example a printer that does not have the face-up ejection function. A first diverging section 301 allows a secondary conveyance section 401 to diverge from the primary conveyance section 20. The first diverging section 301 is located downstream of the image forming unit 10 in the paper conveyance direction C1 and upstream of the primary exit port 21 in the paper conveyance direction C1 in the primary conveyance section 20. The secondary conveyance section 401 includes a conveyance path L71, a plurality of conveyance roller pairs, and a drive mechanism. The first diverging section 301 is located closer to the first side wall 51A than the first diverging section 30. The secondary conveyance section 401 conveys paper S to a proximal end 60A1 of the sorting ejection section 60 through an opening 51C1 formed in the side wall 51A of the housing 50.

It is therefore possible to ensure the distance W1 between the plane including the second side wall 51B of the housing 50 and the plane including the distal ends 67 (distal ends 67A to 67D) of the exit trays 64 (exit trays 64A to 64D) in the image forming apparatus 101 described with reference to FIG. 2 as well as in the image forming apparatus 100. That is, it is possible to ensure the distance W1 while maintaining the configuration in which the conveyance path L8 connects to the conveyance paths L9 such that the sorting conveyance section 62 can convey the paper S therethrough. The distance W1 (for example, 130 mm) is greater than the distance W2 (for example, 60 mm), allowing the paper S to be easily taken out. Furthermore, it is possible to ensure that the distance between the upper end of the top wall 52 of the housing 50 and the upper end 68D of the uppermost exit tray 64D is the distance H1 (for example, 295 mm) and that the distance H1 is shorter than the distance H2. Thus, the height of the image forming apparatus 101 can be configured shorter than the image forming apparatus 103 according to the reference example.

Figure 3:
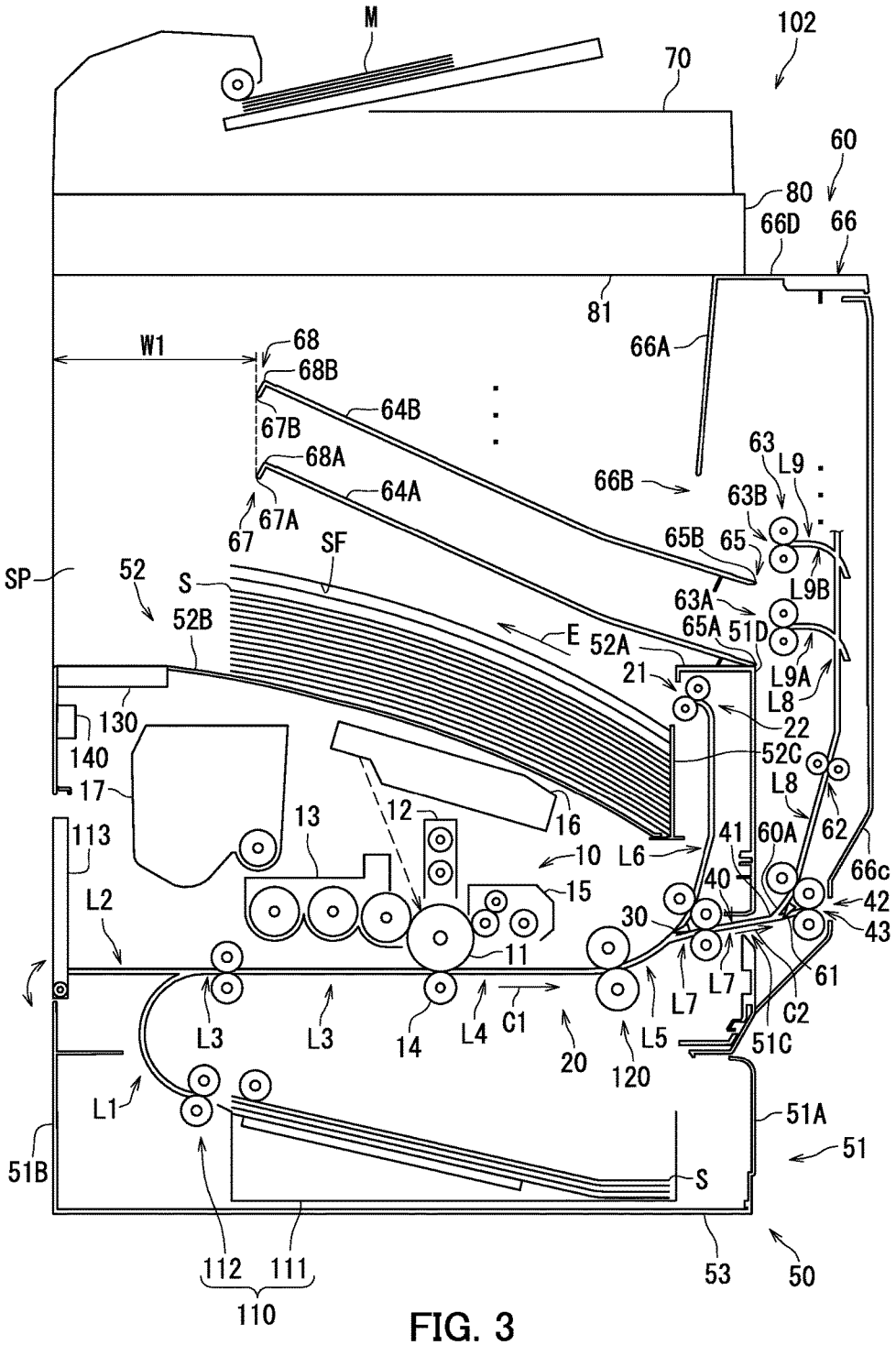
FIG. 3 is a side view illustrating a second variation of the image forming apparatus illustrated in FIG. 1.

The following describes a second variation of the image forming apparatus 100 according to the present embodiment with reference to FIG. 3. FIG. 3 is a side view illustrating an image forming apparatus 102 according to the second variation. The image forming apparatus 102 is different from the image forming apparatus 100 illustrated in FIG. 1 in that the image forming apparatus 102 further includes a document conveying device 70 and an image reading section 80. Note that description is omitted with respect to elements of configuration of the image forming apparatus 102 illustrated in FIG. 3 that are the same as or similar to those of the image forming apparatus 100 illustrated in FIG. 1. Furthermore, the exit trays 64C and 64D, the sorting ejection roller pairs 63C and 63D corresponding to the exit trays 64C and 64D, and the conveyance paths L9C and L9D in the sorting ejection section 60 illustrated in FIG. 1 are not shown in FIG. 3 in order to facilitate illustration.

The image forming apparatus 102 further includes the document conveying device 70 and the image reading section 80 that are disposed above the sorting ejection section 60. The image forming apparatus 102 is for example a multifunction peripheral (MFP). The image forming apparatus 102 has functions of a scanner, a copier, a printer, and a facsimile (FAX) machine. The sorting ejection section 60 illustrated in FIG. 3 has the same configuration as the sorting ejection section 60 described with reference to FIG. 1.

The document conveying device 70 conveys an original document M, which is a reading target, to the image reading section 80. The image reading section 80 optically reads an image of the original document M. The image reading section 80 is for example a scanner. The image reading section 80 is contained in a housing having a substantially rectangular parallelepiped shape. The image reading section 80 transmits data of the read image to the image forming unit 10.

The image forming apparatus 102 has an exit space SP to which paper S is ejected. The exit space SP is located between a bottom surface 81 of the image reading section 80 and the primary exit tray 52B. The bottom surface 81 of the image reading section 80 is coupled to an upper end of the sorting ejection section 60. More specifically, the bottom surface 81 of the image reading section 80 is coupled to an upper end 66D of the cover portion 66. The exit trays 64 project toward the exit space SP.

As described above with reference to FIG. 3, the image forming apparatus 102 including the image reading section 80 can also implement the sorting ejection function for paper S using the exit space SP. The height of the image forming apparatus 102 including the image reading section 80 can therefore be configured short.

Through the above, an embodiment of the present disclosure has been described with reference to the drawings (FIGS. 1 to 4). However, the present disclosure is not limited to the above embodiment and may be implemented in various different forms that do not deviate from the essence of the present disclosure (for example, as described below in section (1)). Elements of configuration disclosed in the above variations of the embodiment can be combined as appropriate in various different forms. For example, some of the elements of configuration in the variations of the embodiment may be omitted. Furthermore, elements of configuration in different variations of the embodiment may be combined as appropriate. The drawings schematically illustrate elements of configuration in order to facilitate understanding. Properties of the elements of configuration illustrated in the drawings such as thickness, length, quantity, and spacing may differ from reality in order to aid preparation of the drawings. Furthermore, properties of elements of configuration in the above embodiment, such as materials, shapes, and dimensions, are merely examples that do not impose any particular limitations and can be altered in various ways to the extent that there is not substantial deviation from the effects of the present disclosure.

(1) The second diverging section 61 and the secondary ejection roller pair 43 illustrated in FIGS. 1 and 3 are located at an opposite side of the first side wall 51A of the housing 50 to a side at which the image forming unit 10 is located. However, the present disclosure is not limited to such a configuration. The second diverging section 61 and the secondary ejection roller pair 43 may for example be contained in the housing 50.

What is claimed is:

1. An image forming apparatus comprising:

an image forming section configured to form an image on paper;

a primary conveyance section configured to convey the paper from the image forming section and ejects the paper;

a first diverging section located downstream of the image forming section in a paper conveyance direction in the primary conveyance section;

a secondary conveyance section diverging from the primary conveyance section at the first diverging section;

a sorting ejection section configured to sort and eject the paper conveyed thereto by the secondary conveyance section;

an image reading section disposed above the sorting ejection section and configured to read an image of an original document; and a housing constituting an apparatus main body and configured to house the image forming section, the primary conveyance section, the first diverging section, and part of the secondary conveyance section, wherein the housing includes a top wall forming a top face of the housing, a bottom wall, and side walls stood from the bottom wall, the top wall includes an inner wall and a primary exit tray, the inner wall having a primary exit port through which the primary conveyance section ejects the paper, the primary exit tray being a tray on which the paper ejected through the primary exit port is placed, one side wall of the side walls has an opening, the one side wall being located opposite to the inner wall with the primary conveyance section therebetween, the secondary conveyance section conveys the paper to a proximal end of the sorting ejection section through the opening, the proximal end of the sorting ejection section is located adjacent to an end portion of the secondary conveyance section at a side farther from the first diverging section, the opening of the one side wall is located at a level between a level of an upper end of the image forming section and a level of a lower end of the image forming section, the primary conveyance section ejects the paper such that a printed side of the paper is facing downward, the printed side being a side on which an image has been formed, the secondary conveyance section includes a secondary exit port and ejects the paper through the secondary exit port such that the printed side is facing upward, the sorting ejection section includes:

an exit tray to which the paper is ejected;

a second diverging section located downstream of the first diverging section in a paper conveyance direction in the secondary conveyance section; and a sorting conveyance section diverging from the secondary conveyance section at the second diverging section and configured to convey the paper toward the exit tray, the secondary exit port is located downstream of the second diverging section in the paper conveyance direction in the secondary conveyance section, the sorting ejection section further includes a sorting ejection roller pair configured to eject, to the exit tray, the paper conveyed thereto by the sorting conveyance section, the sorting ejection roller pair is located at an opposite side of a plane including the one side wall to a side at which the image forming section is located, the exit tray is located above the top wall and protrudes so as to face the top wall, and a bottom surface of the image reading section is coupled to an upper end of the sorting ejection section.

2. The image forming apparatus according to claim 1, wherein a proximal end of the exit tray is located on a plane including the one side wall or at an opposite side of the plane to a side at which the image forming section is located.

3. The image forming apparatus according to claim 1, wherein the sorting ejection section includes a plurality of the exit trays, and a proximal end of the undermost exit tray among the plurality of the exit trays is located on an upper end of the one side wall.

4. An image forming apparatus comprising:

an image forming section configured to form an image on paper;

a primary conveyance section configured to convey the paper from the image forming section and ejects the paper;

a first diverging section located downstream of the image forming section in a paper conveyance direction in the primary conveyance section;

a secondary conveyance section diverging from the primary conveyance section at the first diverging section;

a sorting ejection section configured to sort and eject the paper conveyed thereto by the secondary conveyance section; and a housing constituting an apparatus main body and configured to house the image forming section, the primary conveyance section, the first diverging section, and part of the secondary conveyance section, wherein the housing includes a top wall forming a top face of the housing, a bottom wall, and side walls stood from the bottom wall, the top wall includes an inner wall and a primary exit tray, the inner wall having a primary exit port through which the primary conveyance section ejects the paper, the primary exit tray being a tray on which the paper ejected through the primary exit port is placed, one side wall of the side walls has an opening, the one side wall being located opposite to the inner wall with the primary conveyance section therebetween, the secondary conveyance section conveys the paper to a proximal end of the sorting ejection section through the opening, the proximal end of the sorting ejection section is located adjacent to an end portion of the secondary conveyance section at a side farther from the first diverging section, the opening of the one side wall is located at a level between a level of an upper end of the image forming section and a level of a lower end of the image forming section, the primary conveyance section ejects the paper such that a printed side of the paper is facing downward, the printed side being a side on which an image has been formed, the secondary conveyance section includes a secondary exit port and ejects the paper through the secondary exit port such that the printed side is facing upward, the sorting ejection section includes:

an exit tray to which the paper is ejected;

a second diverging section located downstream of the first diverging section in a paper conveyance direction in the secondary conveyance section; and a sorting conveyance section diverging from the secondary conveyance section at the second diverging section and configured to convey the paper toward the exit tray, the secondary exit port is located downstream of the second diverging section in the paper conveyance direction in the secondary conveyance section, the sorting ejection section further includes a sorting ejection roller pair configured to eject, to the exit tray, the paper conveyed thereto by the sorting conveyance section, the sorting ejection roller pair is located at an opposite side of a plane including the one side wall to a side at which the image forming section is located, the exit tray is located above the top wall and protrudes so as to face the top wall, and the primary conveyance section and the secondary conveyance section convey the paper having passed through the image forming section in a substantially horizontal direction toward the secondary exit port.

5. The image forming apparatus according to claim 4, wherein a proximal end of the exit tray is located on a plane including the one side wall or at an opposite side of the plane to a side at which the image forming section is located.

6. The image forming apparatus according to claim 4, wherein the sorting ejection section includes a plurality of the exit trays, and a proximal end of the undermost exit tray among the plurality of the exit trays is located on an upper end of the one side wall.

* * * * *